United States Patent [19]

Yeh

[11] Patent Number: 5,024,387

[45] Date of Patent: Jun. 18, 1991

[54] ON LINE CONTROL METHOD TO DETERMINE MEDIA FLUIDIZATION IN A MEDIA MILL

[75] Inventor: An-Gong Yeh, Broomall, Pa.

[73] Assignee: E. I. du Pont de Nemours and Company, Wilmington, Del.

[21] Appl. No.: 515,697

[22] Filed: Apr. 26, 1990

Related U.S. Application Data

[63] Continuation of Ser. No. 384,814, Jul. 25, 1989, abandoned.

[51] Int. Cl.[5] ..... B02C 25/00

[52] U.S. Cl. ..... 241/21; 241/30; 241/34; 241/172

[58] Field of Search ..... 241/73, 30, 36, 34, 241/24, 33, 171, 172, 21

[56] References Cited

U.S. PATENT DOCUMENTS

| | | | |
|---|---|---|---|
| 3,243,128 | 3/1966 | Tight | 241/172 |
| 3,350,018 | 10/1967 | Harris et al. | 241/34 |
| 3,640,476 | 2/1972 | Engels | 241/172 |
| 3,652,021 | 3/1972 | Engels | 241/172 |
| 3,770,214 | 11/1973 | Gabor | 241/172 |
| 4,303,205 | 12/1981 | Geiger et al. | 241/172 |
| 4,402,462 | 9/1983 | Lohnherr | 241/34 X |
| 4,461,428 | 7/1984 | Williams | 241/73 X |
| 4,848,676 | 7/1989 | Stehr | 241/34 X |

FOREIGN PATENT DOCUMENTS

| | | | |
|---|---|---|---|
| 447123 | 5/1936 | United Kingdom | 241/34 |

OTHER PUBLICATIONS

Fluidization of Solids, 1950 Edition Unit Operation.

*Primary Examiner*—Mark Rosenbaum
*Attorney, Agent, or Firm*—John M. Lynn

[57] ABSTRACT

A method for optimizing the processing of continuous media mills is disclosed. It has been found that using a differential pressure device to measure the pressure drop across the mill allows the on line determination of the state of media fluidization in the mill. Operation within an optimum mill base flow rate range is needed to have good fluidization of the media so that grinding can be efficient. Using differential pressure measurement allows a precise determination of the mill base flow rate range which provides full fluidization of the media and mill base flow rate control within that range.

4 Claims, 8 Drawing Sheets

ON LINE CONTROL METHOD TO DETERMINE MEDIA FLUIDIZATION IN A MEDIA MILL

This application is a continuation of application Ser. No. 07/384,814 filed July 25, 1989, now abandoned.

FIELD OF THE INVENTION

This invention relates to a method of using a differential pressure measurement to determine the state of media fluidization in a media grinding mill. It is known that the preparation of paints, printing inks, various colouring materials, pharmaceutical products, cosmetic products and other materials requires a milling process to grind, deagglomerate and disperse particulate solids in a liquid. In the paint industry, the liquid containing particulate matter is often called "mill base." This grinding process is needed in order to obtain fine grades of granulate which have been reduced to particle sizes on the order of a hundred microns to sub-microns in diameter. This process is preferably performed with mixing equipment followed by a continuous grinding apparatus. The method consists of introducing the liquid containing the particulate matter into a vessel containing grinding media; grinding the particulates in the liquid by forcing the liquid through the grinding media while rapidly moving the grinding media; and separating the liquid containing the particulates from the grinding media as it leaves the vessel.

The typical apparatus consists of a closed container in which is situated a rapidly rotating shaft having discs or other protrusions attached to it. Other methods of rapidly moving the media are also suitable. The mill is partly filled with the "media", which are spheres of about 0.15–4.8 millimeters in diameter and are made of such things as steel, glass, sand, zirconium silicate, zirconium, alumina, ceramics and so forth. Media mills are well known in the art and are disclosed in U.S. Pat. Nos. 4,303,205; 3,770,214; 3,652,021; 3,640,476; 3,350,018; and 3,243,128 which are incorporated herein by reference.

In the case of vertical media mills, a mixture of pigment (particulate matter) and a polymer solution (liquid) enters the mill from the bottom and, after being subjected to a grinding action by the rapidly moving media, exits at the top. A screen or other separating device, situated at the top of the mill prevents loss of the media from the mill.

The result obtained is on the whole satisfactory, but the energy transmitted to the grinding or milling device is partially dissipated by impact or by wear of the pieces in motion. Thus, it is a problem with media mills to achieve an optimum adjustment of the various operating parameters for the product to be processed efficiently. The operating parameters include such variables as temperature, supply pressure of the feed pump, throughput, speed of the pump and the stirring mechanism, and the quantity and size of the milling media.

Previously the adjustment of the various operating parameters took place manually on the basis of values derived from experience. However, we have found that in practice it is surprisingly easy to develop either one of two undesirable conditions during operation of the mill. If the flow rate of the mill base mixture is too low, all the media ends up sitting on the bottom of the mill and grinding is very inefficient. This condition is called gravitational packing. If the flow rate is too high, on the other hand, all the media ends up packed against the screen at the top of the mill and grinding is again very inefficient. This condition is called hydraulic packing. Optimum operating conditions are needed to have good fluidization of the media so that grinding can be efficient.

A reduction or elimination of hydraulic packing or gravitational packing of the media can result not only in significantly improved efficiency (i.e. power savings and reduced cycle time), but also in improved product quality, reduced equipment and media wear, reduced contamination of the product and improved temperature and pressure control.

What is needed is a method of grinding in a media mill in which hydraulic packing and gravitational packing of the media are reduced or eliminated by on line monitoring of the process.

SUMMARY OF THE INVENTION

We have discovered that using a differential pressure device to measure the pressure drop across the mill, allows the on line determination of the state of media fluidization in the mill. Operation within an optimum flow rate range is needed to have good fluidization of the media so that grinding can be efficient. Using differential pressure measurement allows a precise determination of the flow rate range which provides full fluidization of the media. (While it is possible to predict the media fluidization region using mathematical models our invention gives on line positive control of the parameters). This method of ensuring media fluidization applies to horizontal media mills as well.

BRIEF DESCRIPTION OF THE INVENTION

DETAILED DESCRIPTION OF THE INVENTION

When filling the vertical mill with a liquid or a dispersion, there is a pressure drop across the mill due to the weight of this mill base. Based upon Newton's second law this pressure drop is calculated as the product of liquid weight (liquid density times gravitational constant) and liquid height:

$$dP = f g h$$

where dP = pressure drop across the distance f = fluid density g = gravitational constant h = liquid height or the distance between the top and bottom sensors.

The presence of media in the mill shows no change in the pressure drop when there is no flow, because, assuming that media density is higher than the liquid density, the media is supported by the vessel bottom. As soon as the mill base flow and the agitation starts, the pressure drop begins to increase as the flow rate increases because part of the media is lifted and suspended by the liquid upflow forces. However, at this time, with most of the media still settled at the bottom of the vessel, the mill is in a condition called media gravitational packing.

Upon increasing the mill base flow rate further to a critical point, the combined forces from mill base flow and agitation will lift and suspend virtually all media and result in complete media fluidization. At this point, the bottom of the vessel no longer supports any media and the forces required to suspend the media equal the weight of the media. The pressure drop measured from the sensors will reflect the total weight of liquid and media:

$$dP = [(1-m)f + m\ m\ ]g\ h$$

$$dP = avg\ g\ h$$

where $_m$ is the volume fraction of the media and $_{avg}$ is the average density of fluid and media. This pressure drop remains constant with an increasing mill base throughput rate and media remains fully fluidized. Within this range, the hydraulic force resulting from the increased flow rate does not alter the overall flow pattern of the media.

As the mill base flow is further increased, eventually there is a shift in the media which concentrates the media at the top of the mill and begins to interlock into immobile layers. At this point there is a sudden increase in the differential pressure resulting from the increased friction loss due to liquid mill base passing through the densely packed media layers. This is the onset of the condition known as hydraulic packing. Flow rate increased beyond the onset of hydraulic packing result in rapid differential pressure increases with increases in mill base flow rate.

Figure 1:
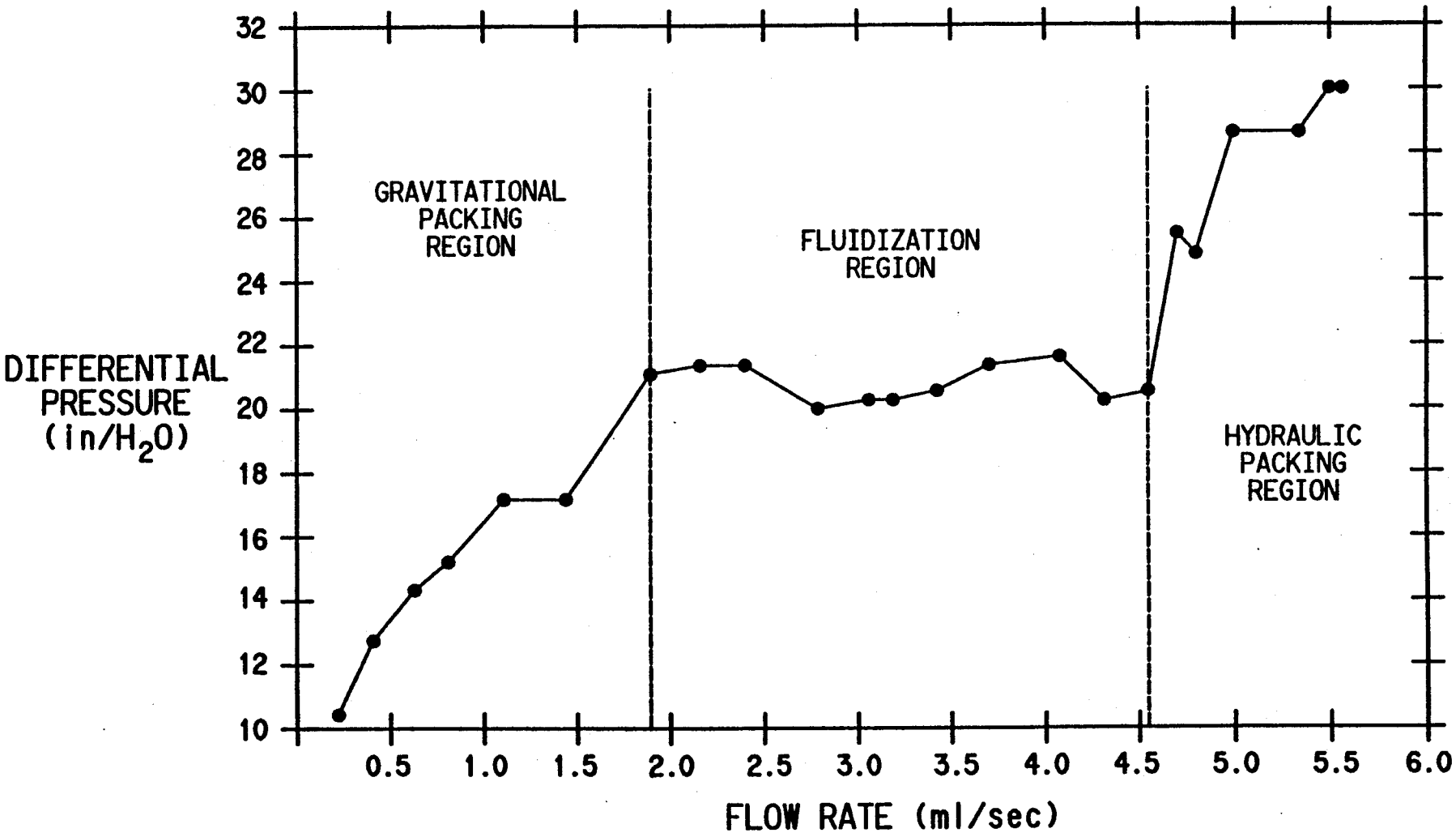
FIG.1 shows a typical S-shaped curve when plotting differential pressure vs. mill base flow rate.

Thus, when plotting differential pressure against flow rate the result is an S-shaped curve through the gravitational packing region, the fluidization region, and the hydraulic packing region. An example of this curve is clearly shown in FIG.1 (FIG.1 relates to an experiment run in a small laboratory sized vertical media mill and is included solely to show the typical shape of the S-shaped curve. Detailed quantitative examples of the S-shaped curve for larger media mills are included in the Example Section).

Figure 5:
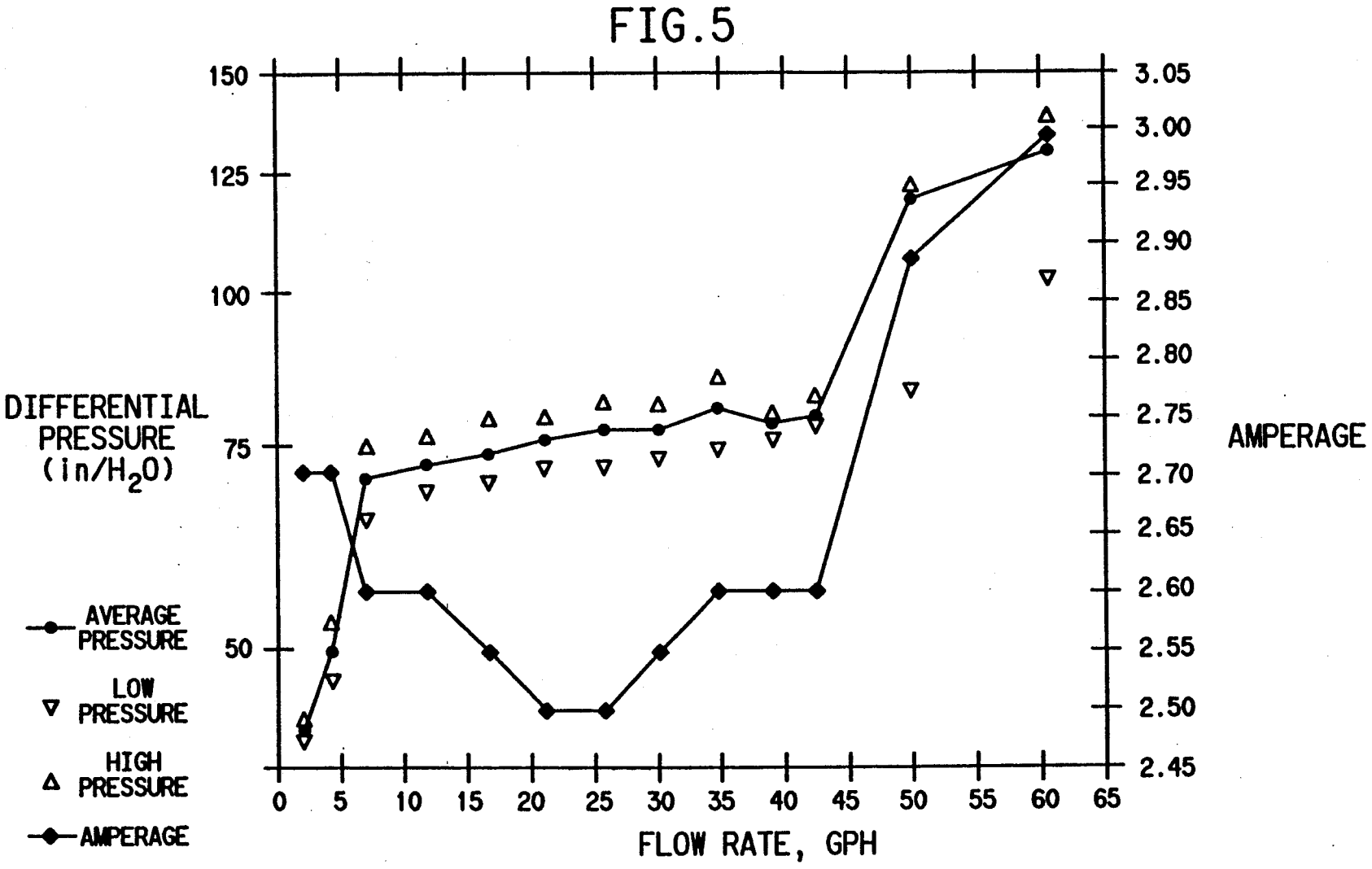
FIG.5 shows a differential pressure vs. mill base flow rate curve with 0.8mm zirconium silicate media and 70% bed volume. This figure also plots the amperage to the shaft motor.

It is also important to note that the power input to the shaft motor when operating in the media fluidization region is minimized as shown in FIG.5. However, because the accurate measurement of power is difficult in a production unit, the use of amperage or power input to the shaft motor as a means of controlling media fluidization is much less practical than the use of differential pressure.

Figure 7:
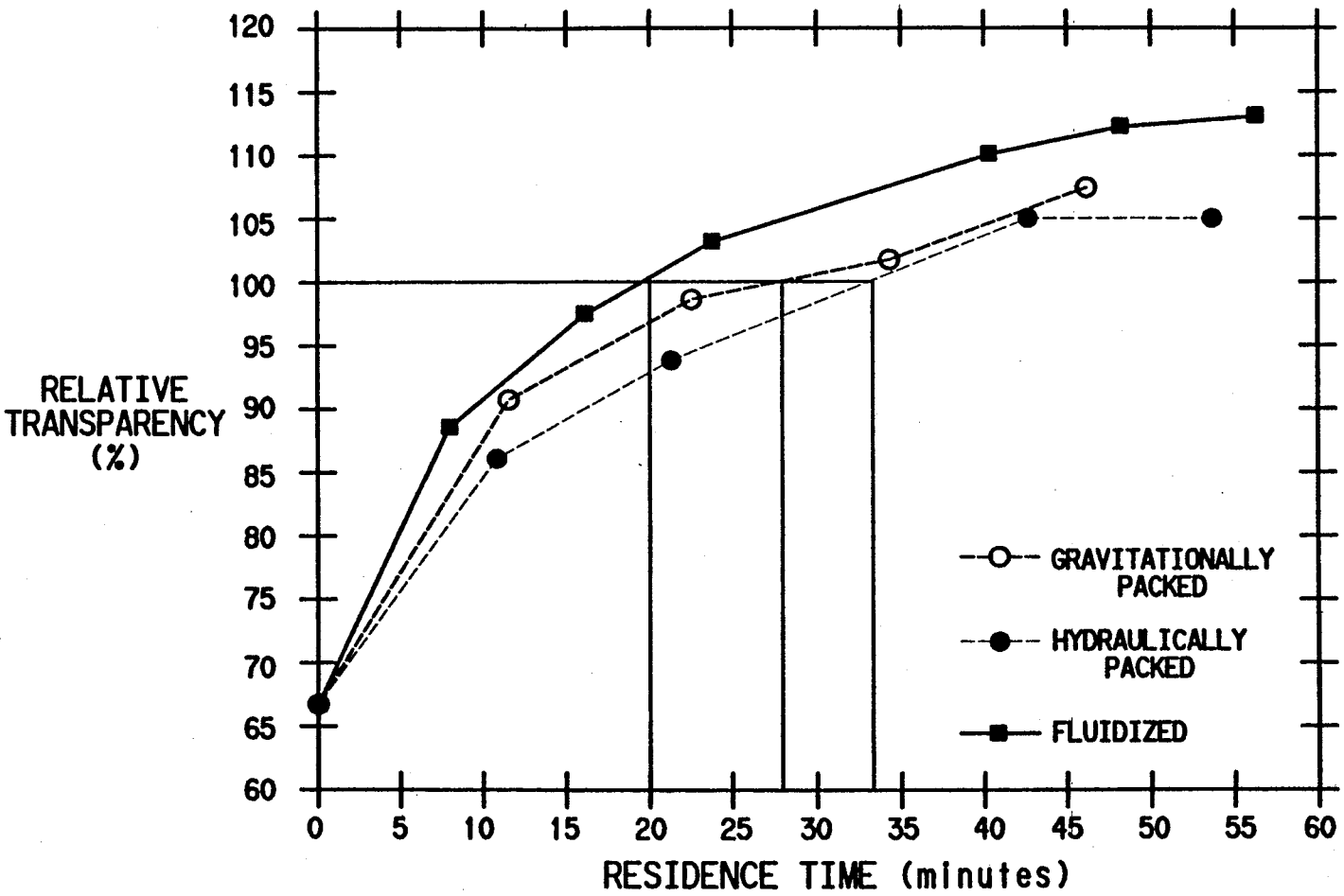
FIG.7 shows the effect of media flow pattern on product quality by plotting relative transparency vs. residence time in the mill.

Monitoring the relationship between differential pressure and mill base flow rate (the S-shaped curve) is the key to our invention. Using this relationship it is possible to empirically detect when the system is operating in the fluidization region. This is very important because, as discussed above, in this region the grinding is more efficient and thus cycle time can be minimized, improved process controllability, there is less wear and tear on the equipment and media, and product quality is improved as shown in FIG.7. To determine the media fluidization region for a specific media mill it is a simple matter of monitoring the differential pressure versus the mill base flow rate. During gravitational packing (when the flow rate is low) the differential pressure will increase as the flow rate is increased. When the media are in the fluidized state the differential pressure levels off even though the flow rate is still being increased. As the flow rate is further increased, at some point the differential pressure begins to climb again as the system enters the hydraulic packing region. Obviously, if a media mill is equipped with a differential pressure measuring system then an operator can monitor flow rate and differential pressure and when the differential pressure levels off as flow rate is increased the operator can determine that the system is operating in its media fluidization region.

Once the differential pressure levels off, the operator should increase the mill base flow rate slightly to ensure that reductions in flow rate do not take the system back into the gravitational packing region. Normally, mill bases increase in viscosity as grinding proceeds. This will result in a shift of the media fluidization range to lower mill base flow rates. Thus, it is also important not to operate too close to the onset of hydraulic packing.

It is obvious that differential pressure measurements could be used to control the mill base flow rate by either manually adjusting the flow rate (i.e. adjusting the pump) or the differential pressure signal can be used to automatically control mill base flow rate through the use of a computer or a central processing unit.

Another advantage of using the differential pressure monitoring method is that potentially more media volume can be used in the media mill. This is important because the more media volume, the more efficient the grinding, and therefore the lower the cycle time. In the past, increasing the media volume past about 75% of the mill empty volume was difficult because the higher the media volume the narrower the media fluidization plateau (i.e. the narrower the range of mill base flow rates which result in media fluidization). But with the novel process of our invention we have found that we can increase our media volume to over 90% of the mill empty volume despite the narrower fluidization region. This is because the differential pressure monitoring of the process allows us to operate on a narrower fluidization plateau. In the past, it has been extremely difficult to repetitively operate on this narrow plateau since no direct fluidization measurement capability existed.

The disclosure and examples focus upon application of differential pressure measurements to vertical media mills because vertical media mills involve both gravitational and hydraulic media packing. However, the method of this invention is also applicable in horizontal mills. Horizontal mills differ from vertical mills in that gravitational packing does not normally occur because agitation alone can fully fluidize the media. However, mill base flow rates above a critical level will cause hydraulic media packing. Therefore just as in vertical mills it is important in horizontal mills that the state of media fluidization be monitored and controlled.

EXAMPLES

Equipment

Figure 8:
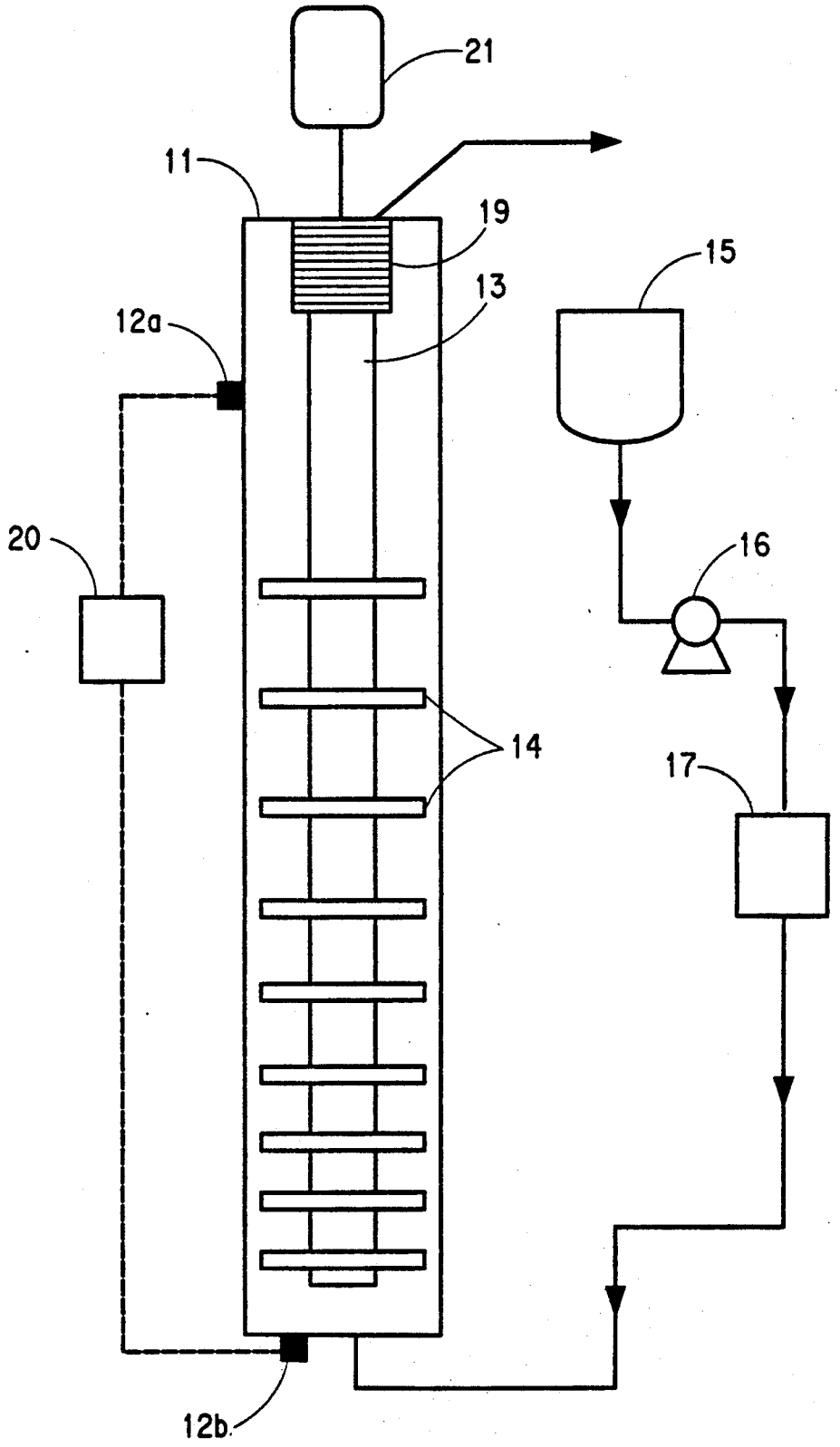
FIG.8 is a schematic of the mill and feed system used in our examples.

All of the examples discussed below were run using a 8 inch diameter Schold Mill 11. This model is available from the Schold Machine Corporation under model HSSM-8 for steel shot. This model includes the vessel shell as well as shaft 13, disks 14, media separator and shaft motor 21. A diagram of the experimental setup is shown in FIG.8. The individual components are discussed below.

Pump 16 is a self-lubricating Houdaille Viking Pump powered by a 1.0 HP Reliance Electric motor. Pump 16 was used to feed the liquid from premixer 15 to mill 11. Flow rate was monitored by flow meter 17. Flow meter 17 was a mass flow meter available from Micro Motion Corporation under model number D-40S-SS. Feed back control was employed to smoothly adjust the flow rate.

Shaft motor 21 was a 20 HP Reliance Duty Master A-C Motor and a belt drive was used to rotate mill shaft 13 on which was mounted nine discs 14 and a Johnson screen 19 at the top of shaft 13 to retain the media in the mill. Shaft speed was controlled manually at the Schold mill but was left constant at a disc tip speed of 10.0 meters per second. Motor amperage was monitored and the energy input by shaft motor 21 was directly calculated by a computer.

Mill 11 was also equipped with two differential pressure sensors 12*a* and 12*b*. These two sensors were Sensotec Corporation (Model A-205 Subminiature Flush Diaphragm) Pressure Transducers, with a range of 0 to 25 psi. Sensors 12*a* and 12*b* were installed on mill 11 for the determination of differential pressure. Sensor 12*b* was located at the bottom of the mill shell and sensor 12*a* was placed at the media filling port. (An additional screen was welded on the bottom plate to prevent sensor 12*b* from contacting the media). Sensor 12*a* was installed 3 inches away from the vessel wall and no screen protector was used. The vertical separation of these sensors was 32 inches. Each sensor was connected to an amplifier 20 also available from Sensotec Corporation (Model SA-BII). The amplifier 20 is connected to a display device (not shown) available from Sensotec Corporation (model SA-10D) which was used to view the pressure for each transducer and the differential pressure of the two transducers.

The experimental system also had a data acquisition system which is not shown in FIG.8. An Analog Devices' MacSym 200 computer converted process signals to digital data which was displayed by an Analog Devices' MacSym 150 terminal. Operating conditions including the gauge and differential pressure of the two pressure transducers, mill base temperature, mill base flow rate and shaft motor 21 amperage were displayed and recorded. The Schold mill system was equipped with the capability to control flow rate and automatically shut off the mill at a low mill base flow rate, high operating pressure and high operating temperature.

The media used for the experiments in the Schold Mill were zirconium silicate and steel shot. The 0.8mm zirconium silicate was obtained from SEPR Quartz Products under stock number ER120A. The 0.8mm steel shot was obtained from Schold Corporation.

Schold Mill Operation

The experiments performed on the Schold Mill were designed to determine the differential pressure under various operating conditions over a range of mill base flow rates. The mill 11 and pipeline system were cleaned of previous dispersions by flushing with solvents at a high flow rate followed by a water flush. Johnson screen 19 was examined for its cleanness prior to the run. To facilitate the data collection and eliminate the time required for cleaning, glycerin and water mixtures were employed as the dispersion fluid. Fifty-five gallons of glycerin was loaded into the premixer and a predetermined quantity of water was added to bring the viscosity to about 200 centipoises.

Figure 2:
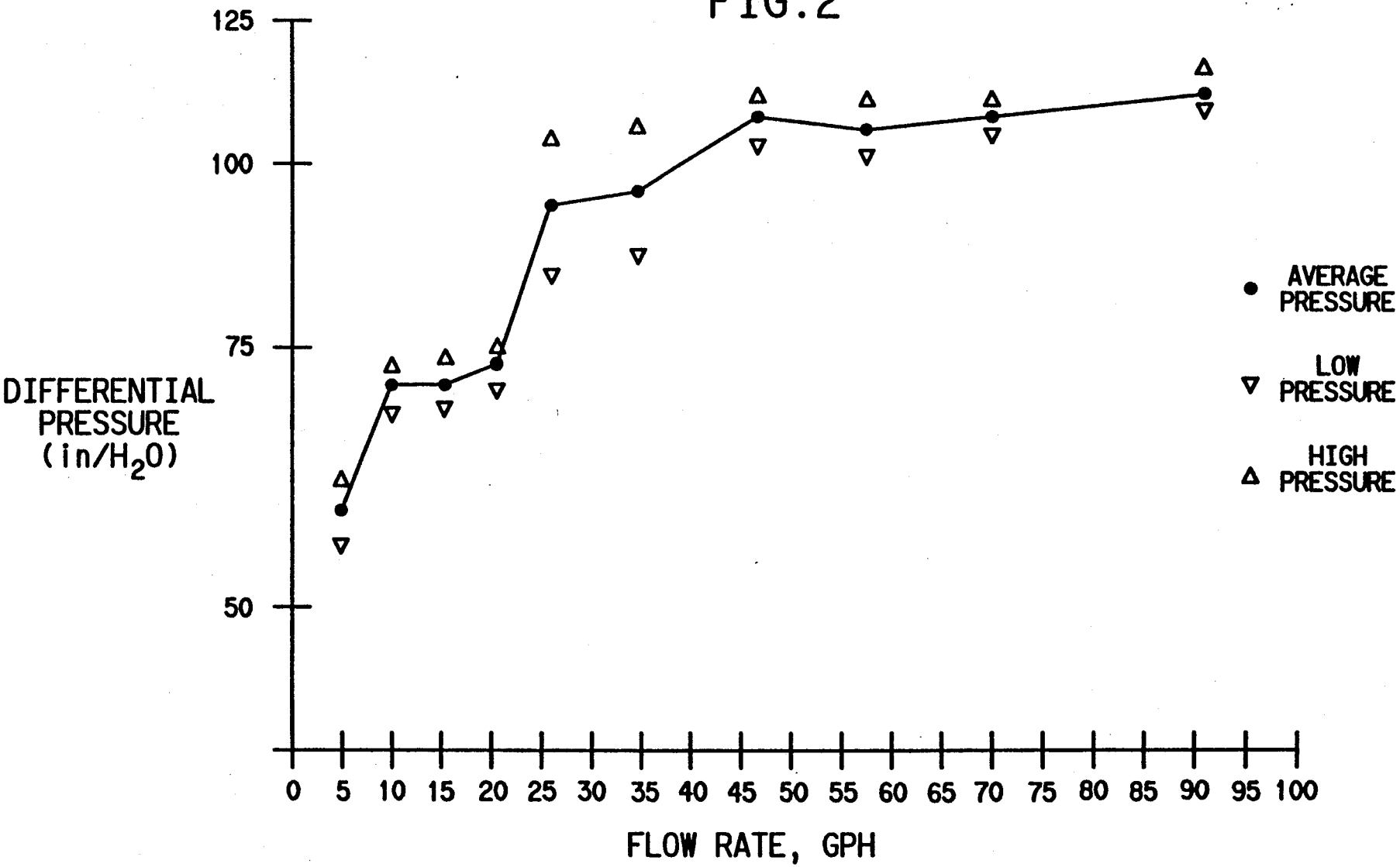
FIG.2 shows a differential pressure vs. mill base flow rate curve with 0.8mm steel media and 55% bed volume (hydraulic packing was not observed in this experiment).

As the mill was emptied and cleaned, a regular media load of 0.8 mm steel shot, corresponding to 0.35 media volume fraction or 55% bed volume, was added through the media fill port. (Media volume fraction is the total fraction of the mill volume occupied by solid media. Media bed volume is the percentage of the mill volume occupied by the media and its associated voids when at rest). Operation of the Schold mill began with the introduction of the liquid, once steady flow had been established through the mill the drive was activated and brought up to speed. When the pressures became stable, operating conditions ( i.e. differential pressure, fluid temperature, flow rate ) were recorded for approximately 5 minutes. The flow rate was then increased and allowed to come to another steady state for another recording. When the differential pressure approached the expected onset of media fluidization, smaller intervals were chosen for the changes in flow rate. This allowed for an accurate determination of the critical transition flow rates for media fluidization. The differential pressure versus mill base flow rate results of this experiment are shown in FIG.2. No hydraulic packing was observed in this experiment.

Figure 3:
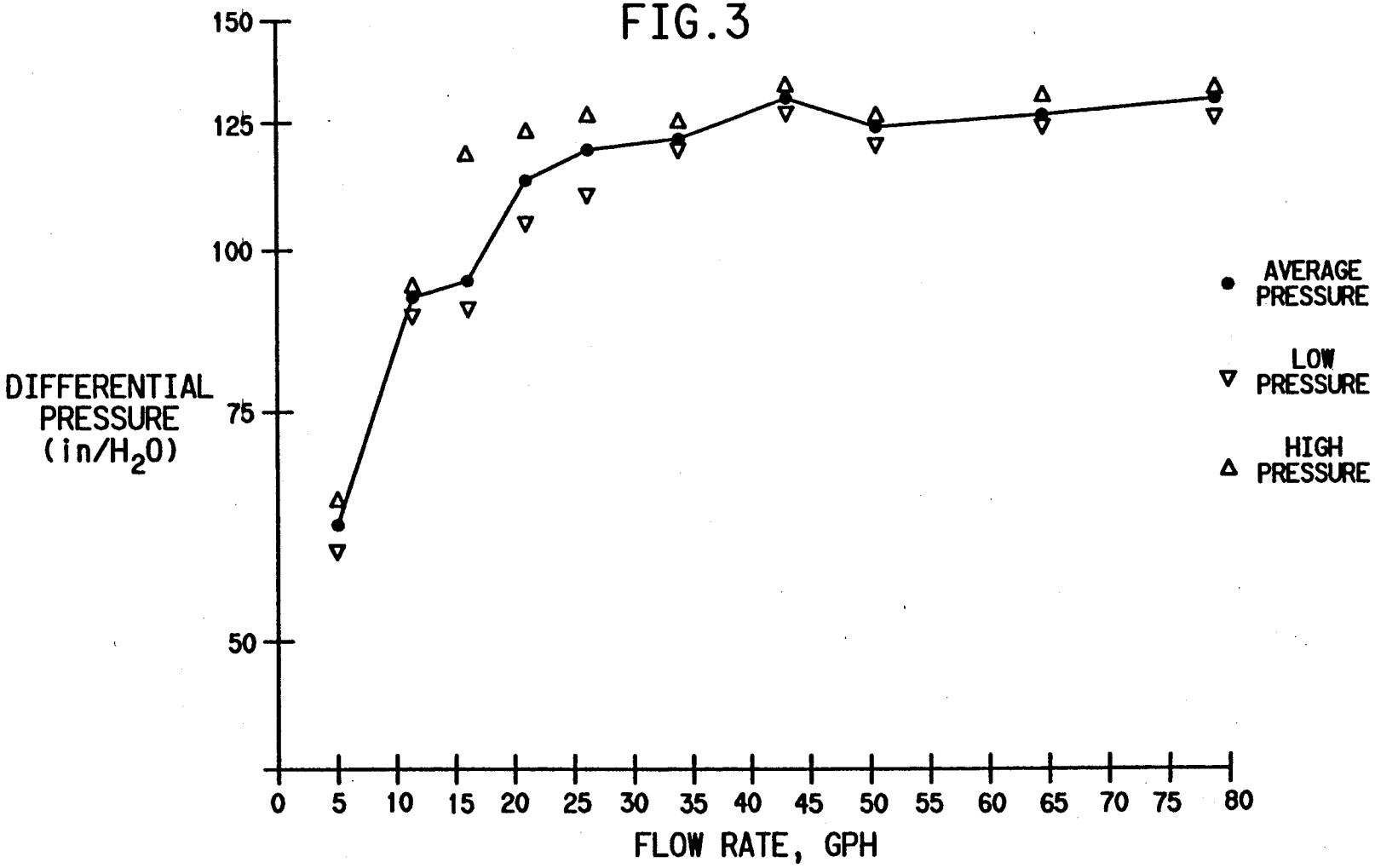
FIG.3 shows a differential pressure vs. mill base flow rate curve with 8mm steel media and 70% bed volume (once again hydraulic packing was not observed).

After generating this series of data, an additional quantity of 0.8mm steel shot was added to the mill to bring the media volume to a total of 0.45 media volume fraction (70% media bed volume) and the experiment was repeated. The differential pressure versus mill base flow rate data are show in FIG.3. No hydraulic packing was seen in this experiment.

Figure 4:
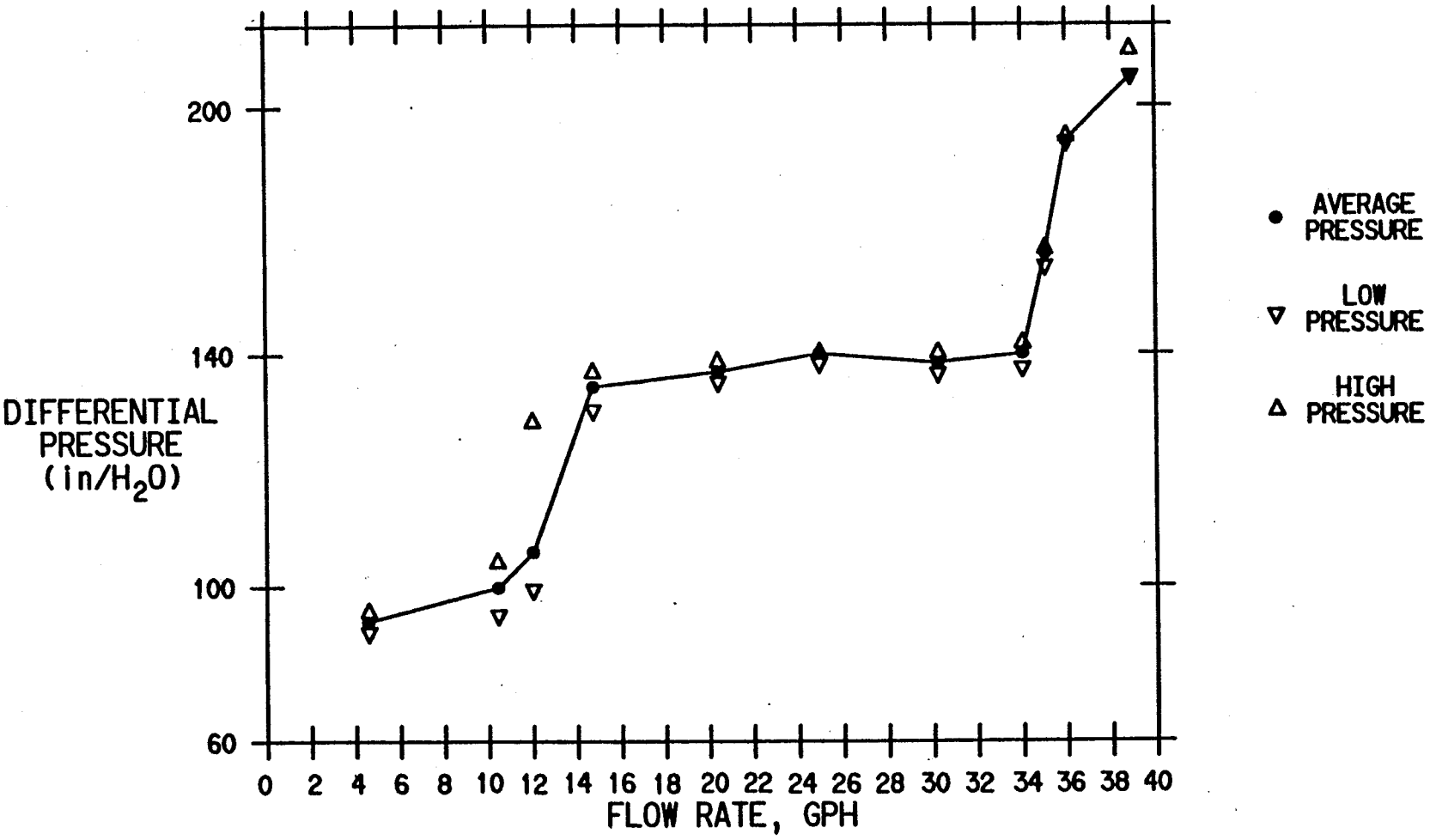
FIG.4 shows a differential pressure vs. mill base flow rate curve with 0.8mm steel media and 86% bed volume (hydraulic packing was observed).

After generating this data, an additional quantity of 0.8mm steel shot was added to the mill to bring the media volume to a total of 0.55 media volume fraction (86% media bed volume) and the experiment was repeated with the mill base flow rate being increased until hydraulic media packing was detected by a sharp increase in differential pressure measurements. The differential pressure versus flow rate results are shown in FIG.4.

The mill was emptied of the steel shot and refilled with 0.8mm zirconium silicate beads to a level corresponding to 0.45 media volume fraction (70% media bed volume). The experiment was repeated as above and amperage measurements on the power input to shaft motor 21 were recorded along with the differential pressure and mill base flow rate measurements. These results are shown in FIG.5 It is obvious from FIG. 5 that operation in the media fluidization region will result in a minimization of power input to the shaft motor 21. Thus, it is possible as a subsidiary control parameter to use power input to the shaft motor 21. However we have found that reproduceability of the power input measurement was not sufficient to allow process control solely using power input.

Figure 6:
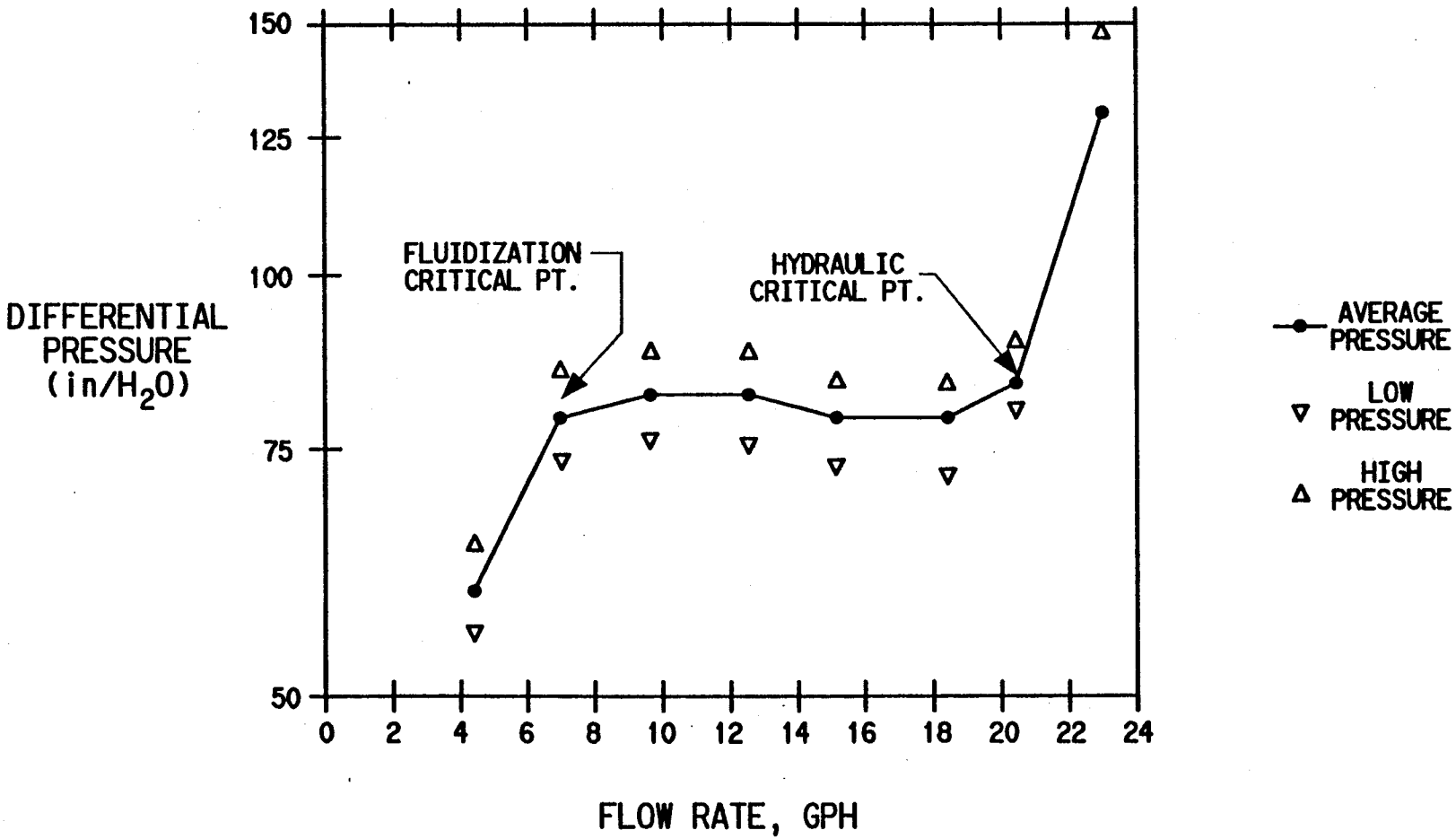
FIG.6 shows a differential pressure vs. mill base flow rate curve with 0.8mm zirconium silicate media and 86% bed volume.

After generating this data, an additional quantity of 0.8mm zirconium silicate beads was added to the mill to bring the media volume to a total of 0.55 media volume fraction (86% media bed volume) and the experiment was repeated with the mill base flow rate being increased until hydraulic media packing was detected by a sharp increase in differential pressure measurements. The differential pressure versus flow rate results are shown in FIG.6.

Each of the above experiments was run at a mill base viscosity of 200 centipoises measured at about 80° F. In addition to these experiments, numerous other experiments were run at varying viscosities. The results of these experiments at other viscosities produced similar results and therefore the experiment description and results are not included.

Product Quality Improvement Experiment

FIG.7 shows the results of experiments run on a specific automotive high solids enamel mill base using phthalocyanine blue as the pigment to be dispersed. Using a common mill base feedstock (same batch split 3 ways), three separate dispersion experiments were run. Each of these experiments involved multiple passes of the mill base through the mill to obtain samples representing product quality at various residence times. The measurement of product quality used in this experiment is the degree of transparency relative to that of a preselected mill base standard. The degree of transparency was measured at a fixed cast film thickness. The relative transparency of the sample is its percentage of the transparency of the standard.

The first of these batches was deliberately processed at a mill base flow rate (determined by the differential pressure measurement) in the gravitationally packed region. The second batch was deliberately processed at a mill base flow rate (determined by the differential pressure measurement) in the hydraulically packed region. The third batch was processed at a mill base flow rate (determined by the differential pressure measurement) which ensured processing at full media fluidization. It is obvious in FIG. 7 that the rate and the extent of the mill base quality development was optimized under full media fluidization conditions. Both the hydraulically packed and gravitationally packed experiments resulted in reduced efficiency in the rate and extent of mill base quality development. Comparing the results of these three batches indicated that the batch processed under full media fluidization condition achieved a standard product quality in 20 minutes residence time. These results compare favorably with the 28 minutes residence time required by the gravitationally packed experiment and the 33 minutes residence time required by the hydraulically packed experiment to reach the standard product quality. This represents a 29% improvement in productivity for fully fluidized processing versus gravitationally packed processing and a 39% improvement in productivity for fully fluidized processing versus hydraulically packed processing. Additionally, under fully fluidized processing, a higher level of product quality was achieved regardless of residence time than could be achieved from either gravitationally or hydraulically packed processing.

I claim:

1. In a continuous method of grinding, deagglomerating or dispersing particulate solids in a liquid, said method comprising: introducing the liquid containing the particulate solids into a vessel containing grinding media; grinding the particulate solids in the liquid by forcing the liquid at a flow rate through the grinding media while rapidly moving the grinding media; and separating the liquid containing the particulate solids from the grinding media as it leaves the vessel; wherein the improvement comprises maintaining the media in a state of fluidization by monitoring a differential pressure measurement across some length of the vessel, the differential pressure being measured by at least two pressure sensors, and adjusting the liquid flow rate accordingly.

2. The method of claim 1 wherein the adjusting of the liquid flow rate is accomplished manually.

3. The method of claim 1 wherein the adjusting of the liquid flow rate is accomplished automatically using the differential pressure measurement.

4. The method of claim 3 wherein the automatic adjustment of liquid flow rate is accomplished using a computer or central processing unit.

* * * * *